US005985209A

United States Patent [19]

Kimura et al.

[11] Patent Number: 5,985,209

[45] Date of Patent: Nov. 16, 1999

[54] MARTENSITIC STEEL FOR LINE PIPE HAVING EXCELLENT CORROSION RESISTANCE AND WELDABILITY

[75] Inventors: Mitsuo Kimura; Yukio Miyata; Tomoya Koseki; Takaaki Toyooka; Fumio Murase, all of Aichi, Japan

[73] Assignee: Kawasaki Steel Corporation, Japan

[21] Appl. No.: 08/821,512

[22] Filed: Mar. 21, 1997

[30] Foreign Application Priority Data

Mar. 27, 1996 [JP] Japan ..... 8-071819
Oct. 29, 1996 [JP] Japan ..... 8-286848

[51] Int. Cl.[6] ..... C22C 38/42; C22C 38/44

[52] U.S. Cl. ..... 420/61; 420/57; 420/58; 420/67

[58] Field of Search ..... 148/325, 327, 148/909; 420/67, 68, 57, 58, 61

[56] References Cited

U.S. PATENT DOCUMENTS 5,049,210 9/1991 Miyasaka et al. ..... 148/909
5,383,983 1/1995 Kondo et al. ..... 148/325

FOREIGN PATENT DOCUMENTS 2-243740 9/1990 Japan .
4-99128 3/1992 Japan .
5-156409 6/1993 Japan .
8-41599 2/1996 Japan .

*Primary Examiner*—Deborah Yee
*Attorney, Agent, or Firm*—Austin R. Miller

[57] ABSTRACT

A martensitic steel for a line pipe having excellent corrosion resistance and weldability is disclosed. The martensitic steel contains about:

0.02 wt % or less of C, 0.50 wt % or less of Si,
0.2 to 3.0 wt % of Mn, 10 to 14 wt % of Cr,
0.2 to 7.0 wt % of Ni, 0.2 to 5.0 wt % of Mo,
0.1 wt % or less of Al, 0.07 wt % or less of N, and
the balance being Fe and incidental impurities; and these elements satisfy substantially the following equations:

$$(Cr\ \%)+(Mo\ \%)+0.1(N\ \%)-3(C\ \%)\geqq 12.2,$$

$$(Cr\ \%)+3.5(Mo\ \%)+10(N\ \%)+0.2(Ni\ \%)-20(C\ \%)\geqq 14.5, \text{ and}$$

$$150(C\ \%)+100(N\ \%)-(Ni\ \%)-(Mn\ \%)\leqq 4.$$

The martensitic steel may further contain at least one element selected from the group consisting of
about 2.0 wt % or less of Cu, about 0.15 wt % or less of Ti, about 0.15 wt % or less of Zr, about 0.15 wt % or less of Ta and
about 0.006 wt % or less of Ca, and
these elements satisfy substantially the following equations:

$$(Cr\ \%)+(Mo\ \%)+0.1(N\ \%)+3(Cu\ \%)-3(C\ \%)\geqq 12.2,$$

$$(Cr\ \%)+3.5(Mo\ \%)+10(N\ \%)+0.2(Ni\ \%)-20(C\ \%)\geqq 14.5,$$

$$150(C\ \%)+100(N\ \%)-(Ni\ \%)-(Mn\ \%)\leqq 4.$$

5 Claims, No Drawings

MARTENSITIC STEEL FOR LINE PIPE HAVING EXCELLENT CORROSION RESISTANCE AND WELDABILITY

BACKGROUND OF THE INVENTION

1. Field of the Invention

The present invention relates to a martensitic steel suitable for transfer steel pipes of oil and natural gas, and having excellent corrosion resistance and weldability.

2. Description of the Related Art

Oil and natural gas supplies have been almost exhausted from easily accessible wells in mild environments, and recent wells must be built in challenging environments, such as severely corrosive environments, cold environments, or in deep wells or in submarine oil fields. Therefore, superior characteristics are required of steel materials used in tubular goods and line pipes in such challenging oil producing regions.

For example, many wells contain large amounts of carbon dioxide gas; carbon steel is highly corroded in such an environment. In order to prevent carbon steel from corroding, inhibitors are injected into pipeline. However, use of inhibitors increases construction and maintenance costs of wells. Further, such inhibitors are not satisfactorily effective at high temperatures. Thus, the recent trend is toward use of corrosion-resistant materials instead of relying on use of inhibitors.

Among corrosion-resistant materials for tubular goods, martensitic stainless steel containing 13 percent by weight (hereinafter referred to as wt %) of Cr is well known. This stainless steel can be produced at low production cost and exhibits excellent corrosion resistance against carbon dioxide gas. However, it is sensitive to sulfide stress corrosion cracking and thus is unsuitable for use in sulfide environments.

Recently, tubular goods of 13% Cr steel containing Mo, Ni and the like have been developed as disclosed in, for example, Japanese Unexamined Patent Publication No. 60-174,859 in order to adapt to environments containing small amounts of hydrogen sulfide. These tubular goods exhibit excellent resistance to sulfide stress corrosion cracking (SSC resistance).

On the other hand, the API Standard defines 12% Cr martensitic stainless steel containing reduced carbon as a line pipe material. However, this stainless steel requires preheating and postheating during circumferential welding, resulting in increased cost and toughness deterioration of the weld section. Thus it is little used.

Because 13% Cr steel containing Ni and Mo does not take into consideration weldability, weld cracks will surely occur when welding line pipes made of such a steel without preheating and postheating.

Accordingly, dual-phase stainless steel, which exhibits excellent weldability and corrosion resistance, has been used in line pipe materials. However, dual-phase stainless steel has unnecessary high cost for some oil and natural gas wells, causing increased well construction costs.

When hot oil or gas flows in a line pipe, the strength of the line pipe decreases. Thus, various corrective measures have been taken, for example, increasing room temperature strength of the line pipe, and increasing pipe thickness. However, increasing room temperature strength has been found to deteriorate weldability, and increasing the pipe thickness of course increases material and production costs.

In summary, no conventional line pipe material exhibits adequately stable corrosion resistance, satisfactory toughness of the weld heat-affected zone, and satisfactory high temperature strength. Further, all the known materials have serious cost disadvantages.

SUMMARY OF THE INVENTION

It is an object of the present invention to provide a martensitic steel for a line pipe which exhibits excellent uniform corrosion resistance and pitting corrosion resistance even in a carbon dioxide environment; excellent sulfide stress corrosion cracking resistance even in an environment containing a small amount of hydrogen sulfide; excellent weldability and toughness and high temperature tensile strength; and reasonable costs.

We have discovered that such objectives can be effectively achieved when the C and N contents in 13% Cr steel are decreased to critical levels, and Ni and Mo, are added along with appropriate amounts of carbide forming elements such as Ti, Zr, Ta and the like, and further appropriate amounts of Nb and V.

In accordance with one embodiment of the present invention, the line pipe martensitic steel comprises about:

0.02 wt % or less of C, 0.50 wt % or less of Si, 0.2 to 3.0 wt % of Mn, 10 to 14 wt % of Cr, 0.2 to 7.0 wt % of Ni, 0.2 to 5.0 wt % of Mo, 0.1 wt % or less of Al, 0.07 wt % or less of N, and the balance being Fe and incidental impurities; these elements substantially satisfying the following equations:

$$(Cr\ \%)+(Mo\ \%)+0.1(Ni\ \%)-3(C\ \%)\geqq 12.2,$$

$$(Cr\ \%)+3.5(Mo\ \%)+10(N\ \%)+0.2(Ni\ \%)-20(C\ \%)\leqq 14.5,$$

$$150(C\ \%)+100(N\ \%)-(Ni\ \%)-(Mn\ \%)\leqq 4.$$

In accordance with another embodiment of the present invention, the martensitic steel comprises about:

0.02 wt % or less of C; 0.50 wt % or less of Si;

0.2 to 3.0 wt % of Mn; 10 to 14 wt % of Cr;

0.2 to 7.0 wt % of Ni; 0.2 to 5.0 wt % of Mo;

0.1 wt % or less of Al; 0.07 wt % or less of N;

at least one element selected from the group consisting of about 2.0 wt % or less of Cu, 0.15 wt % or less of Ti, 0.15 wt % or less of Zr, 0.15 wt % or less of Ta and 0.006 wt % or less of Ca; and the balance being Fe and incidental impurities; these elements substantially satisfying the following equations:

$$(Cr\ \%)+(Mo\ \%)+0.1(Ni\ \%)+3(Cu\ \%)-3(C\ \%)\geqq 12.2,$$

$$(Cr\ \%)+3.5(Mo\ \%)+10(N\ \%)+0.2(Ni\ \%)-20(C\ \%)\geqq 14.5,$$

$$150(C\ \%)+100(N\ \%)-(Ni\ \%)-(Mn\ \%)\leqq 4.$$

The martensitic steel may further contain at least one element selected from Nb and V so at to satisfy substantially the equation:

$$0.02\leqq 0.8(Nb\ \%)+(V\ \%)\leqq 0.20\ wt\ \%.$$

Other objects and features of the present invention will be more apparent to those skilled in the art on consideration of the following specification.

DESCRIPTION OF THE PREFERRED EMBODIMENTS

The basis of the limitation of each aforesaid component in the steel in accordance with the present invention will now be described.

C: about 0.02 wt % or less

It is preferable that the C content be as small as possible in order to improve toughness of the weld heat-affected zone, decrease hardness of the weld heat-affected zone, and maintain corrosion resistance, in particular, pitting corrosion resistance against carbon dioxide gas. Further, the C content must be about 0.02 wt % or less for achieving welding without preheating. Thus, the C content is limited to about 0.02 wt % or less.

Si: about 0.5 wt % or less

Since Si added as a deoxidizer is also a ferrite forming element, a large amount of Si readily forms ferrite and thus deteriorates toughness of the matrix and weld section. If ferrite is present the resulting seamless steel pipe will not be satisfactory. Thus, the Si content is limited to about 0.5 wt % or less.

Mn: about 0.2 to 3.0 wt %

Mn is a useful element for deoxidation and for achieving satisfactory strength. Since this element is also an austenite forming element, it can suppress ferrite formation and improve toughness of the matrix and the weld section. Such advantages cannot be noticeably achieved with a Mn content of less than about 0.2 wt %, whereas these are saturated at a Mn content over about 3.0 wt %. Thus, the Mn content is limited to be within about 0.2 to 3.0 wt %.

Cr: about 10 to 14 wt %

Cr is a fundamental element for martensitic structure formation and satisfactory corrosion resistance and in particular pitting corrosion resistance against carbon dioxide gas. At least about 10 wt % of Cr must be added to achieve such advantages. On the other hand, since ferrite readily forms at a Cr content over about 14 wt %, a large amount of austenite forming element must be added in order to stably form a martensitic structure, which increases cost. Thus, the Cr content is limited to be within about 10 to 14 wt %.

Ni: about 0.2 to 7.0 wt %

Ni offsets disadvantages due to decreased C and N contents as an austenite forming element, and improves corrosion resistance in a carbon dioxide environment and toughness. At least about 0.2 wt % of Ni must be added for achieving such advantages. Additionally, Ni is also added to achieve satisfactory hot workability. However, if about 7.0 wt % or more of Ni is added, the $Ac_1$ point excessively decreases and thus a long annealing period is required for achieving satisfactory characteristics. Accordingly, the Ni content is limited to be within about 0.2 to 7.0 wt %.

Mo: about 0.2 to 5 wt %

Mo is a useful element for improving SSC resistance. At least about 0.2 wt % of Mo must be added for achieving such an advantage. On the other hand, ferrite readily forms and SSC resistance no longer improves for a Mo content over about 5.0 wt %. Thus, the Mo content is limited to be within about 0.2 to 5.0 wt %.

Al: about 0.1 wt % or less

Because Al is added for deoxidation like Si, toughness decreases when Al over about 0.1 wt % is added. Thus, the Al content is limited to about 0.1 wt % or less.

N: about 0.07 wt % or less

It is preferable that the N content be as small as possible like C in order to prevent weld cracking, improve toughness of the weld heat-affected zone, and decrease hardness of the weld heat-affected zone. When the N content exceeds about 0.07 wt %, these advantages cannot be satisfactorily achieved. Thus, the N content is limited to about 0.07 wt % or less, preferably about 0.05 wt % or less.

The steel in accordance with the present invention may include the following elements, if necessary, in addition to essential elements set forth above.

Cu: about 2.0 wt % or less

Cu, as well as Ni and Mn, as an austenite forming element not only compensates for adverse effects due to decreased C and N contents, but also effectively improve toughness of the weld heat-affected zone and uniform corrosion resistance. Further, it improves pitting corrosion resistance in a carbon dioxide or chloride containing environment. However, when the content exceeds about 2.0 wt %, a fraction of the Cu does not dissolve and the formed precipitation deteriorates toughness of the weld heat-affected zone. Thus, the Cu content is limited to about 2.0 wt % or less, and preferably about 0.2 to 0.7 wt %.

Ti, Zr and Ta effectively improve toughness of the matrix and the weld section. Further, these elements react with Cr carbide to form Ti, Zr and Ta carbides. Thus, the Cr component which can effectively improve pitting corrosion resistance still remains in the matrix. When over about 0.15 wt % of these elements are added, the steel is sensitive to weld cracking and its toughness deteriorates. Thus, the contents are limited to about 0.15 wt % or less, respectively, and each is within the range Ti: about 0.15 wt % or less, Zr: about 0.15 wt % or less, and Ta: about 0.15 wt % or less.

Ca: about 0.006 wt % or less

Ca forms CaS and thus can decrease the amount of soluble MnS which adversely affects corrosion resistance. However, if it is present in amounts over about 0.006 wt %, large amounts of cluster inclusions form and deteriorate toughness. Thus, the Ca content is limited to about 0.006 wt % or less.

(0.8Nb+V): about 0.02 to 0.20 wt %

Both Nb and V are useful elements for improving high temperature tensile strength. When the content represented substantially by the equation (0.8Nb+V) is less than about 0.02 wt %, satisfactory high temperature tensile strength at 80 to 150° C. cannot be achieved. On the other hand, toughness deteriorates at a content over about 0.20 wt %. Thus, the content expressed by the equation (0.8Nb+V) is limited to about 0.02 to 0.20 wt %, and preferably about 0.03 to 0.12 wt %.

The contents of useful components are described above. However, in the present invention, a steel having satisfactory characteristics cannot be achieved only by specifying these contents, and must further substantially satisfy at least one of the following equations:

$$(Cr\ \%)+(Mo\ \%)+0.1(Ni\ \%)-3(C\ \%)\geqq 12.2 \quad (1)$$

$$(Cr\ \%)+(Mo\ \%)+0.1(Ni\ \%)+3(Cu\ \%)-3(C\ \%)\geqq 12.2 \quad (2)$$

An object of the present invention is to improve corrosion resistance in a carbon dioxide or chloride containing environment (hereinafter referred to as carbon dioxide corrosion resistance). Stabilization of the passive film effects such an improvement. The passive film is effectively stabilized by an increased amount of Cr and addition of Mo. If Cr forms carbide, the effective Cr content, which contributes to pitting corrosion resistance, decreases. Therefore, a decreased C content improves corrosion resistance. Also, Ni and Cu can stabilize the passive film.

The dependence of carbon dioxide corrosion resistance on these elements was investigated in depth. As a result, it was found that in order to achieve satisfactorily high carbon dioxide corrosion resistance, these elements must be present so as to satisfy substantially one of the equations (1) and (2) set forth above.

Further, the steel in accordance with the present invention must substantially satisfy the following equation (3):

$$(Cr\ \%)+3.5(Mo\ \%)+10(N\ \%)+0.2(Ni\ \%)-20(C\ \%)\geqq 14.5 \quad (3)$$

Another object of the present invention is to improve sulfide stress corrosion cracking resistance in an environment containing a small amount of hydrogen sulfide. Thereby, the SSC resistance of the steel is satisfactorily improved.

The dependence of pitting corrosion resistance on Cr, Mo, N, Ni and C was exhaustively investigated. As a result, it was discovered that in order to achieve the object set forth above, these elements must be present so as to satisfy substantially the above equations (3).

Also, the steel in accordance with present invention must satisfy substantially the following equation (4):

$$150(C\ \%)+100(N\ \%)-(Ni\ \%)-(Mn\ \%)\leqq 4 \quad (4)$$

Since the steel of the present invention is intended for use in line pipes, weldability is an important factor. Particularly, welding without preheating and postheating is essential when it is used in submarine line pipes.

We have discovered that satisfactory weldability without preheating and post heating can be achieved when satisfying substantially the above equation (4).

Among incidental impurities, P and S adversely affect the steel characteristics set forth above. Thus, it is preferable that these contents be limited as follows:

P: about 0.05 wt % or less

P precipitates in crystal grain boundaries and decreases grain boundary strength and deteriorates SSC resistance. Thus, the P content is limited to about 0.05 wt % or less.

S: about 0.005 wt % or less

S precipitates sulfides such as MnS and deteriorates hot workability. Thus, the S content is limited to about 0.005 wt % or less.

Steel prepared with the preferable components set forth above is cast and formed into a seamless steel pipe in a process including a plug mill or a mandrel mill, or into a welded steel pipe for electric resistance welded steel pipe, UOE steel pipe and spiral steel pipe. The produced pipe is annealed according to demand to finish the product.

The following Examples are illustrative of particular forms of the invention. They are not intended to define or to limit the scope of the patent for this invention, which scope is defined in the appended claims.

EXAMPLES

Example 1

A series of steel slabs having compositions set forth in Table 1 were hot-rolled to steel sheets having a thickness of 15 mm. These steel sheets were austenitized and then tempered to ×80 grade strength.

These steel sheets were subjected to an oblique Y-groove weld cracking test defined in JIS-3158 with preheating to 30° C. to evaluate weldability.

Further, the steel sheets were subjected to carbon dioxide corrosion testing to evaluate pitting corrosion resistance and uniform corrosion resistance of the matrices. The test was performed by immersing a test piece of 3.0 mm by 25 mm by 50 mm taken from each matrix into a 20% NaCl solution saturated with 3.0 MPa carbon dioxide in an autoclave at 80° C. for 7 days.

SSC resistance was evaluated by a constant load test based on Method A of NACE-TM 0177, wherein the pH of a 5% NaCl+0.5% $CH_3COOH$ test solution was adjusted to 3.5 by adding $CH_3COONa$, and testing was performed in a 1% $H_2S$+99% $CO_2$ mixed gas stream under a loading stress of 85% SMYS for 720 hours.

These results are set forth in Table 2.

In the column on weld cracking in Table 2, the mark ○ represents "no weld cracking formed" and the mark x represents "weld cracking observed". The uniform corrosion resistance is evaluated with a corrosion rate. The mark ○ in pitting corrosion resistance represents "pitting corrosion not observed" and the mark x represents "pitting corrosion observed". A critical value of 0.127 mm/yr was used to evaluate the carbon dioxide corrosion rate. In reporting results of the SSC test, a non-ruptured sheet is expressed by the mark ○, and a ruptured sheet is expressed by the mark x.

Table 2 illustrates that all steels in accordance with the present invention form no cracking during the oblique Y-groove weld cracking test with preheating at 30° C., and thus exhibit excellent weldability. Further, the results of corrosion tests demonstrate that these steels exhibit excellent carbon dioxide corrosion resistance, pitting corrosion resistance and SSC resistance.

TABLE 1

| | Composition (wt %) | | | | | | | | | | Equation | Equation | Equation | |
|---|---|---|---|---|---|---|---|---|---|---|---|---|---|---|
| No. | C | Si | Mn | Al | Cr | Ni | Mo | N | Cu | Others | (1)* | (2)** | (3)*** | Remarks |
| 1 | 0.010 | 0.25 | 0.44 | 0.02 | 12.1 | 3.86 | 1.02 | 0.024 | 0.49 | | 17.79 | 16.52 | −0.4 | Example |
| 2 | 0.014 | 0.25 | 0.47 | 0.02 | 12.9 | 4.06 | 0.95 | 0.047 | — | | 17.30 | 16.63 | 2.27 | ↑ |
| 3 | 0.013 | 0.24 | 0.45 | 0.02 | 13.1 | 1.15 | 0.52 | 0.025 | 0.50 | Nb:0.047 | 15.83 | 15.93 | 2.85 | ↑ |
| 4 | 0.005 | 0.25 | 0.45 | 0.02 | 12.2 | 5.12 | 2.02 | 0.010 | — | Zr:0.016 | 17.85 | 19.59 | −3.82 | ↑ |
| 5 | 0.009 | 0.26 | 0.44 | 0.02 | 10.7 | 1.47 | 1.55 | 0.015 | — | | 12.29 | 16.33 | 0.94 | ↑ |
| 6 | 0.008 | 0.23 | 0.46 | 0.02 | 11.2 | 1.18 | 0.91 | 0.023 | 0.51 | Ta:0.031 | 14.00 | 14.62 | 1.86 | ↑ |
| 7 | 0.014 | 0.21 | 0.51 | 0.02 | 11.0 | 0.80 | 1.47 | 0.031 | 0.24 | Ca:0.002 | 12.56 | 16.97 | 3.89 | ↑ |
| 8 | 0.016 | 0.20 | 0.50 | 0.02 | 11.9 | 3.95 | 2.24 | 0.011 | — | Ti:0.022 | 16.20 | 20.24 | −0.95 | ↑ |
| 9 | 0.007 | 0.20 | 0.50 | 0.01 | 11.6 | 3.53 | 1.56 | 0.012 | — | V:0.012 | 15.46 | 17.85 | −1.78 | ↑ |
| 10 | 0.019 | 0.21 | 0.51 | 0.02 | 12.1 | 4.07 | 1.93 | 0.011 | — | Nb:0.015<br>Ti:0.043 | 16.52 | 18.74 | −0.63 | ↑ |
| 11 | 0.008 | 0.19 | 0.49 | 0.03 | 11.8 | 4.79 | 3.95 | 0.015 | — | Nb:0.020<br>Zr:0.035 | 16.21 | 26.57 | −2.58 | Example |
| 12 | 0.027 | 0.21 | 1.49 | 0.02 | 11.8 | 0.99 | 0.38 | 0.026 | 0.58 | | 14.55 | 13.05 | 4.17 | Comp. ex. |
| 13 | 0.012 | 0.19 | 1.51 | 0.02 | 11.9 | 0.98 | 1.14 | 0.053 | — | | 12.94 | 16.42 | 4.61 | ↑ |
| 14 | 0.011 | 0.20 | 1.53 | 0.03 | 9.2 | 1.20 | 0.90 | 0.012 | — | | 10.49 | 12.40 | 0.12 | ↑ |
| 15 | 0.012 | 0.19 | 1.50 | 0.02 | 13.1 | 0.75 | 0.37 | 0.011 | 0.45 | Nb:0.025 | 15.24 | 14.27 | 0.65 | ↑ |

TABLE 1-continued

| No. | Composition (wt %) C | Si | Mn | Al | Cr | Ni | Mo | N | Cu | Others | Equation (1)* | Equation (2)** | Equation (3)*** | Remarks |
|---|---|---|---|---|---|---|---|---|---|---|---|---|---|---|
| 16 | 0.011 | 0.22 | 1.48 | 0.02 | 12.1 | 0.01 | 0.91 | 0.013 | — | | 12.08 | 15.53 | 1.46 | ↑ |
| 17 | 0.019 | 0.19 | 1.51 | 0.02 | 11.9 | 1.66 | 1.43 | 0.055 | — | | 13.67 | 17.35 | 5.18 | ↑ |
| 18 | 0.010 | 0.22 | 1.49 | 0.02 | 10.5 | 1.39 | 1.22 | 0.013 | | Nb:0.014 | 12.00 | 14.92 | −0.08 | ↑ |
| 19 | 0.015 | 0.23 | 1.49 | 0.03 | 11.7 | 1.10 | 0.37 | 0.011 | — | | 12.87 | 12.98 | 0.76 | ↑ |
| 20 | 0.019 | 0.19 | 1.50 | 0.02 | 11.1 | 0.89 | 0.11 | 0.012 | — | | 12.02 | 11.23 | 1.66 | ↑ |

*(Cr %) + (Mo %) + 0.1(Ni %) + 3(Cu %) − 3(C %) (1)
**(Cr %) + 3.5(Mo %) + 10(N %) + 0.2(Ni %) − 20(C%) (2)
***150(C %) + 100(N %) − (Ni %) − (Mn %) (3)

TABLE 2

| No. | Weld cracking | Corrosion rate (mm/yr) | Pitting corrosion resistance | SSC resistance |
|---|---|---|---|---|
| 1 | ○ | 0.017 | ○ | ○ |
| 2 | ○ | 0.021 | ○ | ○ |
| 3 | ○ | 0.039 | ○ | ○ |
| 4 | ○ | 0.018 | ○ | ○ |
| 5 | ○ | 0.104 | ○ | ○ |
| 6 | ○ | 0.086 | ○ | ○ |
| 7 | ○ | 0.088 | ○ | ○ |
| 8 | ○ | 0.031 | ○ | ○ |
| 9 | ○ | 0.044 | ○ | ○ |
| 10 | ○ | 0.036 | ○ | ○ |
| 11 | ○ | 0.012 | ○ | ○ |
| 12 | x | 0.072 | x | x |
| 13 | x | 0.106 | ○ | ○ |
| 14 | ○ | 0.173 | x | x |
| 15 | ○ | 0.066 | x | x |
| 16 | ○ | 0.134 | ○ | ○ |
| 17 | x | 0.062 | ○ | ○ |
| 18 | ○ | 0.133 | ○ | ○ |
| 19 | ○ | 0.092 | x | x |
| 20 | ○ | 0.139 | x | x |

Example 2

A series of martensitic steel sheets were prepared as in Example 1 from steel slabs having compositions set forth in Table 3.

Various characteristics of the martensitic steel sheets were evaluated as in Example 1. Results are shown in Table 4. The high temperature tensile strength was measured at 100° C. and 150° C., and each tensile strength set forth in Table 4 indicates the ratio of tensile strength at a high temperature to strength at room temperature.

Table 4 demonstrates that steels in accordance with the present invention formed no cracking during the oblique Y-groove weld cracking test with preheating at 30° C. and thus exhibited excellent weldability. Further, the results of corrosion tests demonstrate that these steels exhibited excellent carbon dioxide corrosion resistance, pitting corrosion resistance and SSC resistance. High temperature strength were also improved by adding appropriate amounts of Nb and V.

As set forth above, the martensitic steel in accordance with the present invention exhibited excellent pitting corrosion resistance and uniform corrosion resistance in a carbon dioxide environment and excellent SSC resistance in an environment containing a small amount of hydrogen sulfide, was proved capable of undergoing girth welding without preheating and postheating, and exhibited excellent high temperature tensile strength.

In accordance with the present invention, line pipes for transferring oil and natural gas were inexpensively produced.

TABLE 3

| No. | Composition (wt %) C | Si | Mn | Al | Cr | Ni | Mo | N | Cu | Nb | V | Others | 0.8 Nb +V (wt %) | Equation (1)* | Equation (2)** | Equation (3)*** | Remarks |
|---|---|---|---|---|---|---|---|---|---|---|---|---|---|---|---|---|---|
| 1 | 0.014 | 0.22 | 0.45 | 0.02 | 12.3 | 4.26 | 0.89 | 0.024 | — | 0.010 | 0.062 | | 0.070 | 13.57 | 16.15 | −0.21 | Example |
| 2 | 0.010 | 0.25 | 0.47 | 0.02 | 12.3 | 3.86 | 1.01 | 0.047 | 0.24 | — | 0.094 | | 0.094 | 14.39 | 16.56 | 1.87 | ↑ |
| 3 | 0.010 | 023 | 0.42 | 0.02 | 12.2 | 2.25 | 0.96 | 0.025 | — | 0.016 | 0.052 | Ti:0.047 | 0.065 | 13.36 | 16 47 | 1.33 | ↑ |
| 4 | 0.006 | 0.24 | 0.43 | 0.02 | 13.2 | 4.31 | 2.15 | 0.026 | — | — | 0.066 | Zr:0.016 | 0.066 | 15.76 | 21.90 | −1.24 | ↑ |
| 5 | 0.013 | 0.25 | 0.44 | 0.02 | 12.2 | 5.16 | 1.81 | 0.015 | — | — | 0.054 | | 0.054 | 14.49 | 18.91 | −2.15 | ↑ |
| 6 | 0.011 | 0.23 | 0.49 | 0.02 | 12.6 | 2.42 | 0.89 | 0.023 | 0.51 | 0.038 | 0.042 | Ta:0.031 | 0.072 | 15.23 | 16.64 | 1.04 | ↑ |
| 7 | 0.009 | 0.24 | 0.42 | 0.02 | 12.6 | 4.55 | 1.60 | 0.031 | 0.24 | 0.042 | 0.050 | Ca:0.002 | 0.084 | 15.35 | 19.04 | −0.52 | ↑ |
| 8 | 0.015 | 0.23 | 0.46 | 0.02 | 12.7 | 3.56 | 0.84 | 0.011 | — | — | 0.100 | Ti:0.022 | 0.100 | i3.85 | 16.20 | −0.67 | ↑ |
| 9 | 0.008 | 0.23 | 0.48 | 0.02 | 12.3 | 3.75 | 1.44 | 0.012 | — | 0.023 | 0.074 | Zr:0.012 | 0.092 | 14.09 | 18.20 | −1.83 | ↑ |
| 10 | 0.001 | 0.25 | 0.53 | 0.02 | 12.7 | 4.51 | 1.52 | 0.011 | — | 0.043 | 0.066 | Ca:0.005 Ti:0.043 | 0.100 | 14.64 | 19.03 | −2.29 | ↑ |
| 11 | 0.010 | 0.23 | 0.49 | 0.01 | 11.8 | 5.59 | 2.63 | 0.015 | — | — | 0.119 | | 0.119 | 14.96 | 21.11 | −3.08 | Example |
| 12 | 0.008 | 0.21 | 0.53 | 0.02 | 11.9 | 0.76 | 0.38 | 0.056 | 0.58 | 0.057 | 0.047 | | 0.093 | 14.07 | 14.16 | 5.51 | Comp. ex. |
| 13 | 0.012 | 0.24 | 0.44 | 0.02 | 11.9 | 2.65 | 1.14 | 0.053 | — | 0.007 | 0.064 | | 0.070 | 13.27 | 16.68 | 4.01 | ↑ |
| 14 | 0.011 | 0.25 | 0.43 | 0.02 | 9.5 | 2.51 | 0.06 | 0.012 | — | 0.006 | 0.009 | | 0.014 | 9.78 | 10.27 | −0.09 | ↑ |
| 15 | 0.012 | 0.22 | 0.50 | 0.02 | 12.2 | 3.28 | 0.37 | 0.011 | 0.45 | 0.035 | 0.026 | Ti:0.025 | 0.054 | 14.21 | 13.53 | −0.88 | ↑ |
| 16 | 0.011 | 0.22 | 0.49 | 0.02 | 12.3 | 0.81 | 0.41 | 0.013 | — | 0.004 | 0.010 | | 0.013 | 12.76 | 13.81 | 1.65 | ↑ |
| 17 | 0.019 | 0.27 | 0.51 | 0.01 | 12.1 | 4.62 | 1.43 | 0.065 | — | 0.020 | 0.066 | | 0.082 | 13.94 | 18.06 | 4.22 | ↑ |

TABLE 3-continued

| No. | Composition (wt %) C | Si | Mn | Al | Cr | Ni | Mo | N | Cu | Nb | V | Others | 0.8 Nb +V (wt %) | Equation (1)* | Equation (2)** | Equation (3)*** | Remarks |
|---|---|---|---|---|---|---|---|---|---|---|---|---|---|---|---|---|---|
| 18 | 6.020 | 0.22 | 0.50 | 0.02 | 10.3 | 3.42 | 1.22 | 0.013 | — | 0.018 | 0.120 | Ti:0.014 | 0.134 | 11.80 | 14.58 | 0.38 | ↑ |
| 19 | 0.015 | 0.21 | 0.57 | 0.03 | 11.8 | 1.38 | 0.37 | 0.011 | — | 0.076 | 0.066 | | 0.127 | 12.26 | 13.10 | 1.40 | ↑ |
| 20 | 0.019 | 0.20 | 0.52 | 0.02 | 12.4 | 0.96 | 0.11 | 0.012 | — | 0.007 | 0.044 | | 0.050 | 12.55 | 12.53 | 2.57 | ↑ |

*(Cr %) + (Mo %) + 0.1(Ni %) + 3(Cu %) − 3(C %) (1)
**(Cr %) + 3.5(Mo %) + 10(N %) + 0.2(Ni %) − 20(C%) (2)
***150(C %) + 100(N %) − (Ni %) − (Mn %) (3)

TABLE 4

| No. | Weld cracking | Corrosion rate (mm × yr) | Pitting corrosion resistance | SSC resistance | High temperature strength: Y.S. high temp./Y.S. room temp. 100° C. | 150° C. | Y.S. high temp./Y.S. room temp. 100° C. | 150° C. |
|---|---|---|---|---|---|---|---|---|
| 1 | ○ | 0.091 | ○ | ○ | 0.96 | 0.95 | 0.93 | 0.90 |
| 2 | ○ | 0.078 | ○ | ○ | 0.98 | 0.97 | 0.94 | 0.92 |
| 3 | ○ | 0.093 | ○ | ○ | 0.96 | 0.95 | 0.93 | 0.90 |
| 4 | ○ | 0.040 | ○ | ○ | 0.97 | 0.96 | 0.93 | 0.90 |
| 5 | ○ | 0.072 | ○ | ○ | 0.96 | 0.95 | 0.93 | 0.91 |
| 6 | ○ | 0.056 | ○ | ○ | 0.96 | 0.95 | 0.94 | 0.90 |
| 7 | ○ | 0.051 | ○ | ○ | 0.97 | 0.95 | 0.94 | 0.91 |
| 8 | ○ | 0.087 | ○ | ○ | 0.97 | 0.96 | 0.94 | 0.92 |
| 9 | ○ | 0.076 | ○ | ○ | 0.97 | 0.97 | 0.95 | 0.92 |
| 10 | ○ | 0.063 | ○ | ○ | 0.98 | 0.97 | 0.95 | 0.93 |
| 11 | ○ | 0.042 | ○ | ○ | 0.98 | 0.98 | 0.95 | 0.92 |
| 12 | x | 0.077 | x | x | 0.96 | 0.94 | 0.94 | 0.91 |
| 13 | x | 0.101 | ○ | ○ | 0.96 | 0.95 | 0.94 | 0.91 |
| 14 | ○ | 0.186 | x | x | 0.92 | 0.89 | 0.90 | 0.85 |
| 15 | ○ | 0.073 | x | x | 0.96 | 0.95 | 0.93 | 0.90 |
| 16 | ○ | 0.114 | x | x | 0.92 | 0.90 | 0.89 | 0.85 |
| 17 | x | 0.085 | ○ | ○ | 0.97 | 0.96 | 0.94 | 0.91 |
| 18 | ○ | 0.141 | ○ | ○ | 0.98 | 0.97 | 0.94 | 0.91 |
| 19 | ○ | 0.119 | x | x | 0.97 | 0.96 | 0.93 | 0.90 |
| 20 | ○ | 0.113 | x | x | 0.95 | 0.94 | 0.93 | 0.90 |

What is claimed is:

1. A martensitic steel for a line pipe having excellent corrosion resistance and weldability consisting essentially of about:

0.02 wt % or less of C; 0.50 wt % or less of Si;

0.2 to 3.0 wt % of Mn; 10 to 14 wt % of Cr;

0.2 to 7.0 wt % of Ni; 0.2 to 5.0 wt % of Mo;

0.1 wt % or less of Al; 0.07 wt % or less of N;

0.2 to 2.0 wt % of Cu;

0.15 wt % or less of Ti, 0.15 wt % or less of Zr, 0.15 wt % or less of Ta and about 0.006 wt % or less of Ca; and the balance being Fe and incidental impurities;

the elements Cr, Mo, N, Cu, C, Ni and Mn satisfying substantially the following equations:

$$(Cr\ \%)+(Mo\ \%)+0.1(Ni\ \%)+3(Cu\ \%)-3(C\ \%)\geqq 12.2,$$

$$(Cr\ \%)+3.5(Mo\ \%)+10(N\ \%)+0.2(Ni\ \%)-20(C\ \%)\geqq 14.5, \text{ and}$$

$$150(C\ \%)+100(N\ \%)-(Ni\ \%)-(Mn\ \%)\leqq 4.$$

2. A martensitic steel for a line pipe having excellent corrosion resistance and weldability comprising about:

0.02 wt % or less of C, 0.50 wt % or less of Si, 0.2 to 3.0 wt % of Mn, 10 to 14 wt % of Cr, 0.2 to 3.0 wt % of Ni, 0.2 to 5.0 wt % of Mo, 0.1 wt % or less of Al, 0.07 wt % or less of N, 0.2 to 2.0 wt % of Cu, and at least one element selected from the group consisting of 0.15 wt % or less of Ti, 0.15 wt % or less of Zr, 0.15 wt % or less of Ta, and 0.006 wt % or less of Ca, so as to satisfy the following equations:

$$(Cr\ \%)+(Mo\ \%)+0.1(Ni\ \%)+3(Cu\ \%)-3(C\ \%)\geqq 12.2,$$

$$(Cr\ \%)+3.5(Mo\ \%)+10(N\ \%)+0.2(Ni\ \%)-20(C\ \%)\geqq 14.5, \text{ and}$$

$$150(C\ \%)+100(N\ \%)-Ni-Mn\leqq 4;$$

said martensitic steel further comprising at least one element selected from the group consisting of Nb and V so as to satisfy the following equation:

$$(0.8Nb+V)=0.02 \text{ to } 0.20 \text{ wt } \%, \text{ and}$$

the balance being Fe and incidental impurities.

3. A martensitic steel for a line pipe having excellent corrosion resistance and weldability according to claim 1, wherein the content of Cu is from 0.2 to 0.7 wt %.

4. A martensitic steel for a line pipe having excellent corrosion resistance and weldability comprising about:

0.02 wt % or less of C, 0.50 wt % or less of Si, 0.2 to 3.0 wt % of Mn, 10 to 14 wt % of Cr, 0.2 to 7.0 wt % of Ni, 0.2 to 5.0 wt % of Mo, 0.1 wt % or less of Al, 0.07 wt % or less of N, and 0.2–2.0 wt % of Cu, so as to satisfy the following equations:

$$(Cr\ \%)+(Mo\ \%)+0.1(Ni\ \%)+3(Cu\ \%)-3(C\ \%)\geqq 12.2,$$

$$(Cr\ \%)+3.5(Mo\ \%)+10(N\ \%)+0.2(Ni\ \%)-20(C\ \%)\geqq 14.5, \text{ and}$$

$$150(C\ \%)+100(N\ \%)-(Ni\ \%)-(Mn\ \%)\leqq 4;$$

and the balance being Fe and incidental impurities.

5. A martensitic steel for a line pipe having excellent corrosion resistance and weldability according to claim 4, wherein said martensitic steel further comprises at least one element selected from the group consisting of Nb and V so as to satisfy the following equation:

$$0.8(Nb\ \%)+(V\ \%)=0.02 \text{ to } 0.20 \text{ wt } \%.$$

* * * * *